US012565245B2

(12) United States Patent
Le-Corre et al.

(10) Patent No.: US 12,565,245 B2
(45) Date of Patent: Mar. 3, 2026

(54) RAILWAY VEHICLE WITH COLLISION-PROTECTING CRUSHABLE AREAS

(71) Applicant: ALSTOM Holdings, St Ouen sur Seine (FR)

(72) Inventors: Dominique Marcel Jacques Le-Corre, Val de Moder-Pfaffenhoffen (FR); Adrien Boulay, Saint Ouen (FR)

(73) Assignee: ALSTOM Holdings, Saint-Ouen-sur-Seine (FR)

( * ) Notice: Subject to any disclaimer, the term of this patent is extended or adjusted under 35 U.S.C. 154(b) by 508 days.

(21) Appl. No.: 17/823,482

(22) Filed: Aug. 30, 2022

(65) Prior Publication Data

US 2024/0067236 A1 Feb. 29, 2024

(51) Int. Cl.

| | |
|---|---|
| ***B61D 1/00*** | (2006.01) |
| ***B61D 15/06*** | (2006.01) |
| ***B61D 17/04*** | (2006.01) |
| ***B61D 17/06*** | (2006.01) |
| ***B61D 45/00*** | (2006.01) |
| ***B61G 11/00*** | (2006.01) |
| ***B61G 11/16*** | (2006.01) |

(52) U.S. Cl.

CPC ..... *B61D 1/00* (2013.01); *B61D 15/06* (2013.01); *B61D 17/04* (2013.01); *B61D 17/041* (2013.01); *B61D 17/06* (2013.01); *B61D 45/008* (2013.01); *B61G 11/00* (2013.01); *B61G 11/16* (2013.01)

(58) Field of Classification Search

CPC ..... B61D 1/00; B61D 15/06; B61D 17/06; B61D 17/04; B61D 17/041; B61D 45/008; B61G 11/16; B61G 11/00

USPC ..... 105/397

See application file for complete search history.

(56) References Cited

U.S. PATENT DOCUMENTS

| | | | | |
|---|---|---|---|---|
| 3,911,833 A * | 10/1975 | Bauer | ..... | B61D 17/06 105/402 |
| 4,211,173 A * | 7/1980 | Eggert, Jr. | ..... | B61D 17/06 105/21 |
| 9,090,266 B2 * | 7/2015 | Nakao | ..... | B61D 17/00 |
| 9,434,392 B2 * | 9/2016 | Hirashima | ..... | B61D 17/06 |

(Continued)

FOREIGN PATENT DOCUMENTS

| | | | | |
|---|---|---|---|---|
| DE | 112012002087 T5 * | 7/2014 | ..... | B61D 15/06 |
| EP | 0990815 A1 * | 4/2000 | | |

(Continued)

*Primary Examiner* — S. Joseph Morano
*Assistant Examiner* — James William Jones
(74) *Attorney, Agent, or Firm* — Knobbe, Martens, Olson & Bear, LLP

(57) ABSTRACT

A railway vehicle includes a carbody frame which includes a roof, a bottom side opposed to and spaced apart from the roof, two opposite sides, a front end face, and a rear end face opposite to the front end face. The roof, the bottom side, the two opposite sides and the front and rear end faces delimit altogether an inner space. One or more posts are positioned at at least one of the front and rear end faces and extend, along a substantially vertical axis, for at least a portion of a vertical distance existing between the roof and the bottom side. One or more crushable devices are connected to and extend along the substantially vertical axis for at least a predominant portion of the vertical extension of an associated post of the one or more posts.

11 Claims, 3 Drawing Sheets

(56) References Cited

U.S. PATENT DOCUMENTS

| | | | | |
|---|---|---|---|---|
| 2007/0214996 | A1* | 9/2007 | Nedelik | B61D 15/06<br>105/238.1 |
| 2007/0261591 | A1* | 11/2007 | Bravo | B61D 17/06<br>105/392.5 |
| 2008/0060544 | A1* | 3/2008 | Kawasaki | B61D 17/06<br>105/355 |
| 2008/0116720 | A1* | 5/2008 | Yamaguchi | B61D 15/06<br>296/187.11 |
| 2008/0314282 | A1* | 12/2008 | Malfent | B61D 17/06<br>105/392.5 |

FOREIGN PATENT DOCUMENTS

| | | | | |
|---|---|---|---|---|
| EP | 1257456 | B1 * | 8/2003 | B61D 15/06 |
| EP | 3003816 | B1 | 1/2018 | |
| WO | WO 2012136500 | A1 | 10/2012 | |
| WO | WO 2018121270 | A1 | 7/2018 | |

* cited by examiner

RAILWAY VEHICLE WITH COLLISION-PROTECTING CRUSHABLE AREAS

FIELD OF THE INVENTION

The present invention relates to a railway vehicle provided with collision-protecting crushable areas.

BACKGROUND OF THE INVENTION

As known, as defined by relevant safety standards, during their life service rail vehicles have to withstand determined levels of loads and mechanical efforts, for instance those that may be caused by collisions.

To this end, railway vehicles have a structure properly sized and configured to fulfill such requirements.

For instance, in the USA various types of railway cars, including heavy metros, are fitted at their end faces with vertical collision posts and vertical corner posts which are designed to withstand determined static loads and are suitable to face the effects of collisions protecting occupants from possible injuries.

Although such known solutions provide a good level of protection, there are some aspects worth of further improvements.

For example, railway vehicles of the type above mentioned have a central door at both their end faces, wherein a couple of collisions posts are positioned at the respective door; thus, the space to realize a cab for the driver is located on a side relative to the central door, and at a certain height from the ground level.

When such railway vehicles are in service, the driver's cab can be exposed to collisions with other railway vehicles or, when operating along a main railroad, even with big obstacles, such as trucks, pick-ups, et cetera, e.g. at grade crossings.

In these circumstances the corner posts and the collision posts have to bear also the dynamic loads generated at the impact location and may suffer excessive deformation; in particular, in view of its position, the driver's cab may be exposed to potentially dangerous situations.

SUMMARY OF THE DESCRIPTION

Hence, it is evident from the above that there is room and desire for further improving safety of railway vehicles when incurring in collisions.

The present disclosure is aimed at providing a solution to this end and provides a railway vehicle comprising:

- a carbody frame which includes a roof, a bottom side opposed to and spaced apart from the roof, two opposite sides, a front end face, and a rear end face opposite to the front end face, wherein the roof, the bottom side, the two opposite sides and the front and rear end faces delimit altogether an inner space;
- one or more posts which are positioned at at least one of said front and rear end faces and extend, along a substantially vertical axis, for at least a portion of a vertical distance existing between said roof and said bottom side; and
- one or more crushable devices, the or each crushable device being connected to and extending, along said substantially vertical axis, for at least a predominant portion of the vertical extension of an associated post of said one or more posts.

BRIEF DESCRIPTION OF THE DRAWINGS

Detailed characteristics and advantages will become apparent from the description of some preferred but not exclusive exemplary embodiments of a railway vehicle according to the present disclosure, illustrated only by way of non-limitative examples with the accompanying drawings, wherein.

DETAILED DESCRIPTION

Figure 1:
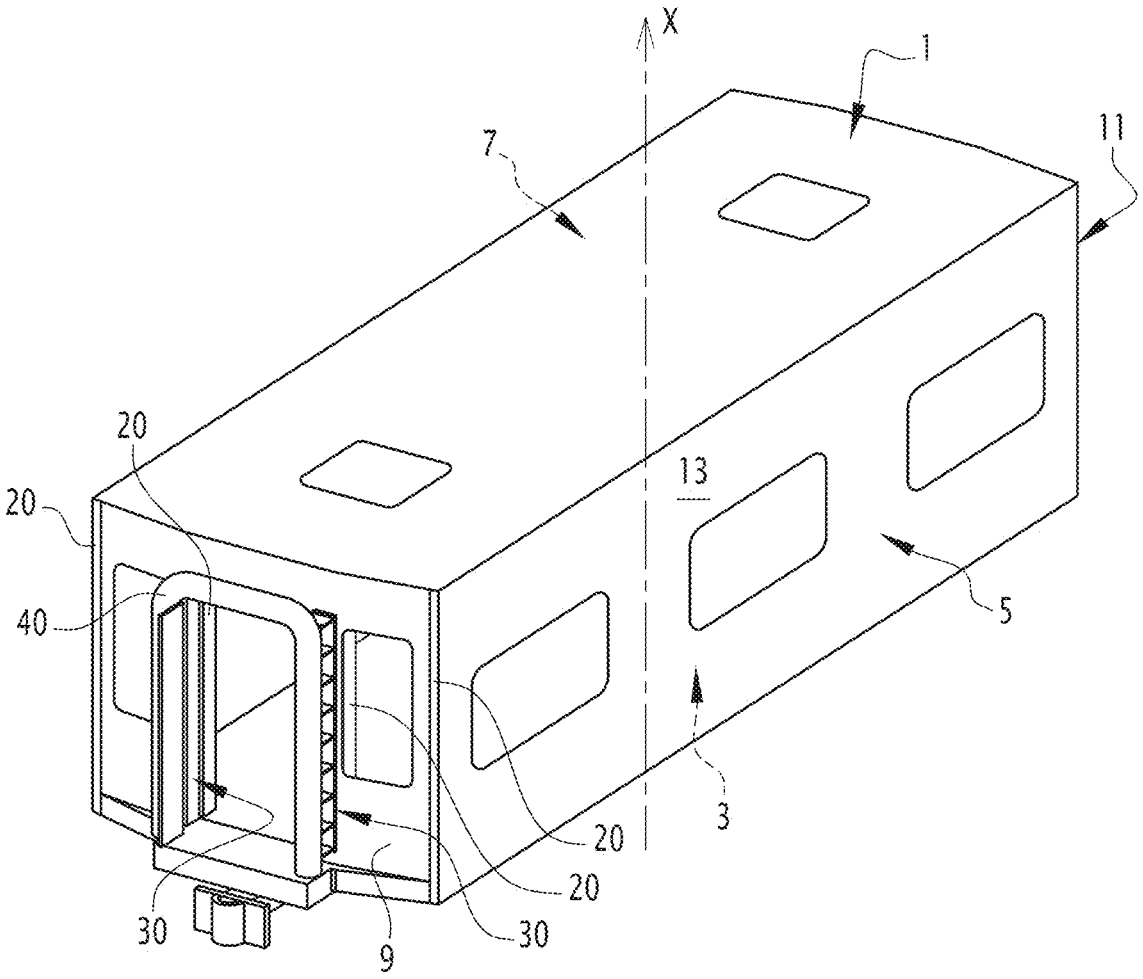
FIG. 1 is a perspective view schematically showing a car body frame of a railway vehicle according to the present disclosure.

It should be noted that in the detailed description that follows, identical or similar components, either from a structural and/or functional point of view, may have the same or different reference numerals, regardless of whether they are shown in different embodiments of the present disclosure. It should be also noted that in order to clearly and concisely describe the present disclosure, the drawings may not necessarily be to scale and certain features of the disclosure may be shown in somewhat schematic form.

Further, when the term "adapted" or "arranged" or "configured" or "shaped", or "set", or any similar term is used herein while referring to any component as a whole, or to any part of a component, or to a combination of components, it has to be understood that it means and encompasses correspondingly either the structure, and/or configuration and/or form and/or positioning.

In addition, when the term "about" or "substantial" or "substantially" is used herein, it has to be understood as encompassing an actual variation of plus or minus 5% with respect to an indicated reference value, or axis, or position, and when the terms transversal or transversally are hereby used, they have to be understood as encompassing a direction non-parallel to the reference part(s) or direction(s)/axis they refer to, and perpendicularity has to be considered a specific case of transverse direction.

FIG. 1 schematically illustrates an exemplary carbody frame of a railway vehicle according to the present disclosure, which includes, according to solutions well known or readily available to those skilled and therefore not described herein in further details:

- a roof 1;
- a bottom side or underframe 3 which is opposed to and spaced apart from the roof 1;
- two opposite sides 5 and 7, which extend both, substantially vertically, from the bottom side 3 to the roof 1;
- a front end face 9 and a rear end face 11 opposite to the front end face. The front end face 9 and the rear end face 11 extend both, vertically between the roof 1 and the bottom side 3, and transversally between the two opposite sides 5 and 7.

The roof 1, the bottom side 3, the two opposite sides 5 and 7, and the front and rear end faces 9 and 11 are mutually assembled to delimit altogether an inner space 13 suitable for accommodating passengers and/or components of the railway vehicles.

The railway vehicle according to the present disclosure comprises also one or more posts 20 which are positioned at at least one of the front and rear end faces 9 and 11, and extend each, along a substantially vertical axis indicated in FIG. 1 with the capital letter X and directed along the conjunction bottom side 3-roof 1. In particular the or each posts 20 extends vertically for at least a portion of the vertical distance (measured along the vertical axis X) existing between the roof 1 the bottom side 3.

Conveniently, the railway vehicle according to the present disclosure comprises also one or more crushable devices, indicated in the figures by the reference number 30, wherein the or each crushable device 30 is connected to and extends, along the substantially vertical axis X, for at least a predominant portion of the vertical extension (along the same direction X) of an associated post 20 of the one or more posts 20.

With the definition of "a predominant portion of the vertical extension" has to be understood that the or each crushable device 30 extends along the vertical axis X for more than 50% of the vertical extension of the post associated therewith.

Figure 2:
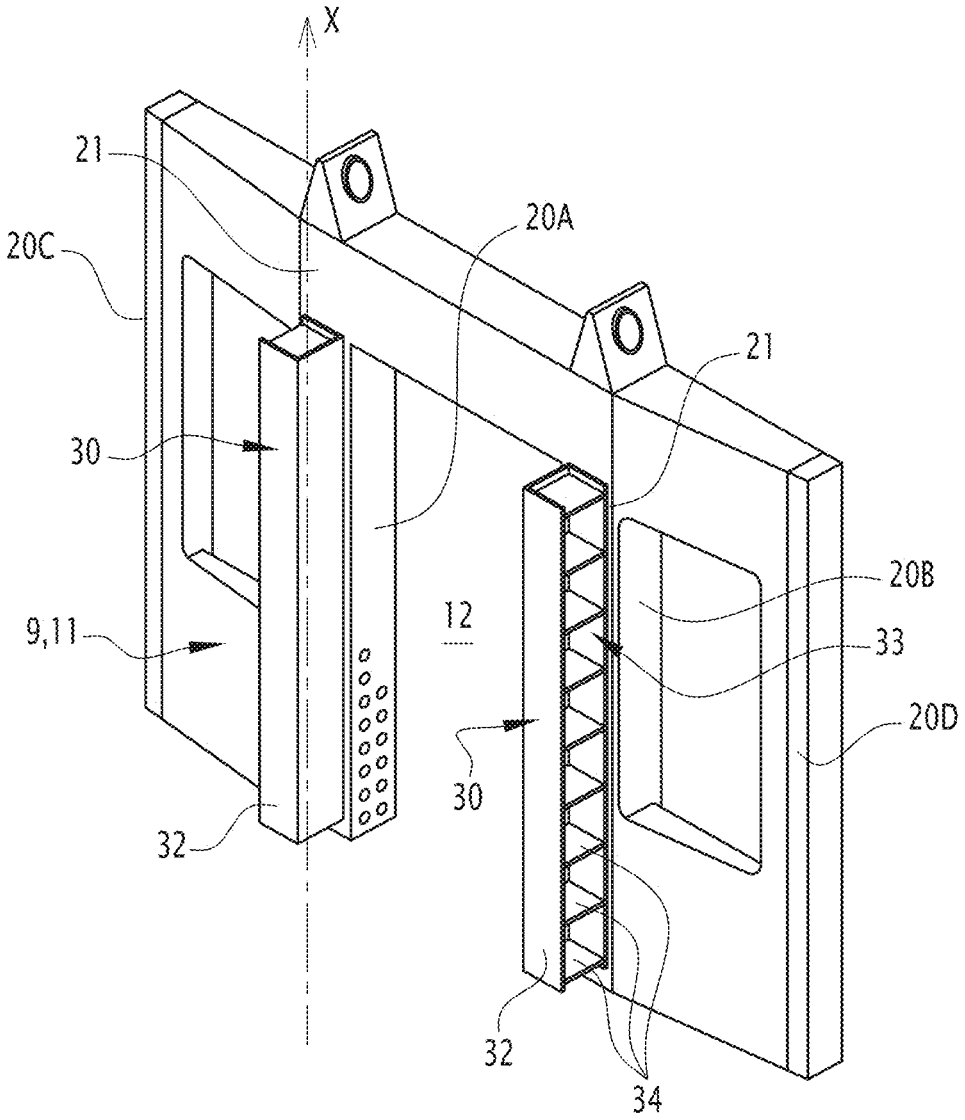
FIG. 2 is a view showing some of the components of the railway vehicle of FIG. 1.
Figure 3:
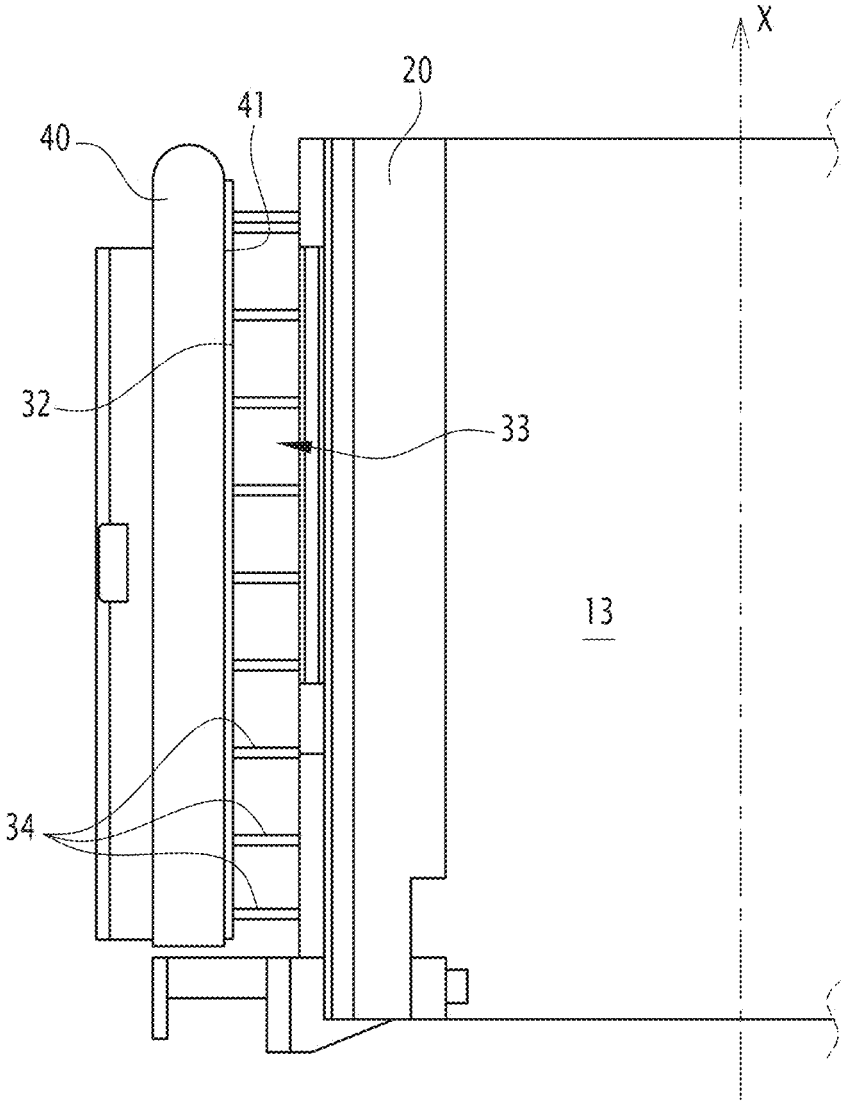
FIG. 3 is a side view showing some components of the railway vehicle of FIG. 1.

FIG. 1 shows the carbody frame of the railway vehicle seen from a front part and thus the various parts, such as the posts 20 and the crushable devices 30 are visible only in relation to the front end face 9; clearly, what described herein, and as illustrated also in FIGS. 2 and 3, is valid for and applicable in an equivalent manner also to the rear end face 11.

In one possible embodiment, the or each crushable device 30 is connected to a surface of the associated post 20 oriented outwardly with respect to the inner space.

Such surface, indicated in FIG. 2 by the reference number 21, lies substantially on the external side of the front end face 9 (or of the rear end face 11 correspondingly) and faces the outside of the carbody frame.

According to a possible embodiment, the or each crushable device 30 is connected in a removable way to a surface of the associated post, i.e. the surface 21, oriented outwardly with respect to the inner space 13. For instance, the or each crushable device 30 is bolted to the surface 21 of the associated post 20.

In one possible embodiment, as for example illustrated in FIGS. 1 and 3, the railway vehicle according to the present disclosure comprises at least one diaphragm 40. Such diaphragm 40 is part of a gangway and is suitable for allowing passageway in and out from the railway vehicle itself, according to solutions well known or readily available to those skilled in the art and therefore not described in details.

In particular, the at least one diaphragm 40 is positioned, outside the inner space 13, in proximity of and spaced apart from the front face 9 (as illustrated in FIG. 1; or likewise of the rear end face 11, as schematically represented in FIG. 2); the crushable device 30, or in any case at least one crushable device 30 of the one or more crushable devices, is interposed between the associated post 20 and the at least one diaphragm 40.

According to a possible embodiment, the crushable device 30 is connected in a removable way, for example bolted, to a surface of the diaphragm 40, indicated in FIG. 3 by the reference number 41, which is positioned facing towards the inner space 13.

In one possible embodiment, as illustrated in FIGS. 1 and 2, at least one of the front and rear end faces 9 and 11 has a through opening 12 suitable to define a passageway, and the one or more posts 20 comprise a first collision post and a second collision post, which are positioned at the sides of the opening 12 and are indicated in FIG. 2 by the respective reference numbers 20A and 20B for the sake of illustration.

According to this embodiment, the one or more crushable devices comprise a first crushable device 30 which is interposed between and is connected to the first collision post 20A and the diaphragm 40, and a second crushable device 30 which is interposed between and is connected to the second collision post 20B and the diaphragm 40.

In particular, the first and second collision posts 20A and 20B are positioned at the sides of the opening 12 and protrudes from the front end face 9 (or likewise from the rear end face 11) inwardly towards the inner space 13 of the carbody frame.

In one possible embodiment, and as illustrated in the figures, at least one crushable device 30 of the one or more crushable devices 30 comprises a frame 32 which extends vertically along the substantially vertical axis and has a U- or C-shaped when seen in cross section, i.e. in a plan transversal to the vertical axis X.

In yet a possible embodiment, the at least one crushable device 30 of the one or more crushable devices further comprises a plurality of plates 34, having for instance a substantially square or rectangular shape, which are connected to the U- or C-shaped frame 32.

In one possible embodiment, all crushable devices 30 used comprise the above indicated frame 32 and the plurality of plates 34 mutually assembled as above indicated.

In particular, the walls of the frame 32 embrace an inner space 33 and the plates 34 are located in such a space 33 and are connected to the frame 32, e.g. welded, spaced apart from each other, for example at substantially regular intervals, in sequence along the substantially vertical axis X.

All crushable devices 30 used in the railway vehicle according to the invention can have the above indicated configuration, namely the frame 32 with the associated plates 34.

According to a possible embodiment, the one or more posts 20 comprise at least a first corner post and a second corner posts, which are indicated in FIG. 2 with the references 20C and 20D for the sake of illustration; the corner posts 20C and 20D are positioned at the corners formed by each of the two opposite sides 3 and 5 with the front end face 9 (or likewise the rear end face 11) and contribute also to the structural robustness of the car body frame and to contrast the effects of possible collisions.

Clearly, if desired and/or according to the applications, crushable devices 30 can be also associated to such corner posts 30, in a way similar to that above described in relation to the collision posts 20A and 20B, e.g. connecting them, in a releasable manner, to a front surface of the corner posts themselves.

As previously mentioned, in the railway vehicle according to the present disclosure, what illustrated in FIG. 1 and above described in relation to the front end face 9 can be replicated mutatis mutandis at the rear end face 9, where the one or more posts 20, the one or more crushable devices, the opening 12 and the diaphragm can be implemented substantially in the same way which is not replicated hereby for the sake of conciseness.

Hence, it is evident that railway vehicle according to the present disclosure has a structure offering an improved resistance to collisions, capable also to properly face collisions with big obstacles at grade crossings, thus increasing the overall safety.

These results are obtained with a solution relatively easy to be implemented and which does not require an excessive redesigning/reworking of the current structure of cardody frames.

Further, in case of collisions where only the crushable devices can result deformed, then the devices or parts thereof deformed can be easily removed and replaced with new ones.

The railway vehicle thus conceived is susceptible of modifications and variations, all of which are within the scope of the inventive concept as defined in particular by the appended claims; for example, the shape and/or position of some of the components described or parts thereof, for instance the frame 32 and or the plates 34, may be varied provided that they are still compatible for the tasks foreseen for them in the railway vehicle according to the present disclosure. If plural crushable devices 30 are used, they may have for instance a different extension or length along the vertical axis X from each other, depending for example on their positioning. The railway vehicle can be of any type of rail car, wagon, carriage (or any similar or equivalent definition), suitable for implementing the peculiar aspects of the solution previously described. All the details may furthermore be replaced with technically equivalent elements.

What is claimed is:

1. A railway vehicle comprising:

a carbody frame which includes a roof, a bottom side opposed to and spaced apart from the roof, two opposite sides, a front end face, and a rear end face opposite to the front end face along a front-rear direction, wherein the roof, the bottom side, the two opposite sides and the front and rear end faces delimit altogether an inner space, wherein a mounting face forming one of said front and rear end faces comprises a through opening configured to define a passageway;

a first collision post and a second collision post which are positioned at the mounting face and extend each, along a substantially vertical axis, for at least a portion of a vertical distance existing between said roof and said bottom side, the first collision post and the second collision posts being positioned at each side of said through opening respectively, while being protruding from the mounting face inwardly towards the inner space;

two crushable devices, parallel and distinct from the first collision post and the second collision post, each of the two crushable devices being connected to and extending, along said substantially vertical axis, for at least a predominant portion of the vertical extension of an associated post of said first and second collision; and a diaphragm of a gangway, which is configured to provide the passageway in and out from the railway vehicle, said diaphragm being positioned, outside said inner space, at and spaced apart from the mounting face with the diaphragm having an attachment surface facing towards said inner space, wherein said first and second crushable devices respectively comprise (i) a frame which extends vertically along said substantially vertical axis, wherein the frame has a U- or C-shaped cross section to form a profile of the vertical extension and has an elongated profile space delimited by two parallel sides and a bottom side of the profile, and (ii) a plurality of plates arranged in a sequence along said substantially vertical axis in the frame, each transversally in the elongated profile space, to be spaced apart from each other, wherein the plurality of plates are connected to the profile, wherein the first crushable device is interposed between and is connected to the first collision post and the attachment surface of the diaphragm, so that the two parallel sides in the profile of the first crushable device are spaced along the front-rear direction, while extending each parallel to the attachment surface of the diaphragm, wherein the second crushable device is interposed between and is connected to the second collision post and the attachment surface of the diaphragm, so that the two parallel sides in the profile of the second crushable device are spaced along the front-rear direction, while extending each parallel to the attachment surface of the diaphragm.

2. The railway vehicle according to claim 1, wherein each of the crushable devices is connected to a surface of the associated post oriented outwardly with respect to said inner space.

3. The railway vehicle according to claim 1, wherein each of the two crushable devices is connected in a removable way to a surface of the associated post oriented outwardly with respect to said inner space, so that the two crushable devices are protruding outwardly from the mounting face.

4. The railway vehicle according to claim 1, wherein each of the two crushable devices is connected in a removable way to the attachment surface of the diaphragm.

5. The railway vehicle according to claim 1, wherein the profiles of the two crushable devices open at two vertical profile sides with opposite orientations so that the respective bottom sides of the profiles are facing each other.

6. The railway vehicle according to claim 1, wherein the first collision post and the second collision post comprise at least a first corner post and a second corner posts which are positioned at the corners formed by each of the two opposite sides with the mounting face.

7. The railway vehicle according to claim 1, wherein each profile of the crushable devices defines three crushable device outer sides, which consist of the two parallel sides and the bottom side in said profile, and wherein the profiles of the two crushable devices are directly carrying the diaphragm.

8. A railway vehicle comprising:

a carbody frame which includes a roof, a bottom side opposed to and spaced apart from the roof, two opposite sides, a front end face, and a rear end face opposite to the front end face along a front-rear direction, wherein the roof, the bottom side, the two opposite sides and the front and rear end faces delimit altogether an inner space, wherein a mounting face forming one of said front and rear end faces comprises a through opening configured to define a passageway;

collision posts positioned at the mounting face and extending each, along a substantially vertical axis, for at least a portion of a vertical distance existing between said roof and said bottom side, the collision posts being distributed to have at least one collision post at each side of said through opening respectively;

two crushable devices, parallel and distinct from the collision posts, each of the two crushable devices being connected to and extending, along said substantially vertical axis, for at least a predominant portion of the vertical extension of an associated post of said collision posts; and a diaphragm of a gangway, which is configured to provide the passageway in and out from the railway vehicle, said diaphragm being positioned, outside said inner space, at and spaced apart from the mounting face with the diaphragm having an attachment surface facing towards said inner space, wherein said first and second crushable devices respectively comprise (i) a frame which extends vertically along said substantially vertical axis, wherein the frame is a vertical frame having a U- or C-shaped cross section, thus having an elongated interior space delimited by two parallel sides and a bottom side of the vertical frame, and (ii) a plurality of plates arranged in a sequence along said substantially vertical axis in the frame, each transversally in the elongated profile space, to be spaced apart from each other, wherein the plurality of plates are connected to said vertical frame, wherein in each of the first crushable device and the second crushable device, the two parallel sides in the corresponding vertical profile are spaced along the front-rear direction, while extending each parallel to the attachment surface of the diaphragm.

9. The railway vehicle according to claim 8, wherein each of the first crushable device and the second crushable device is connected to a surface of the associated post oriented outwardly with respect to said inner space.

10. The railway vehicle according to claim 8, wherein the collision posts comprise at least a first corner post and a second corner post which are positioned at the corners formed by each of the two opposite sides with the mounting face.

11. The railway vehicle according to claim 8, wherein the plates are welded to the frame in the first crushable device and in the second crushable device.

* * * * *